US009359879B2

(12) United States Patent
Gill et al.

(10) Patent No.: US 9,359,879 B2
(45) Date of Patent: Jun. 7, 2016

(54) CYCLONIC SEPARATORS AND METHODS FOR SEPARATING PARTICULATE MATTER AND SOLIDS FROM WELL FLUIDS

(75) Inventors: Alistair Gill, Katy, TX (US); Paul Ellerton, Derby (GB); David Fielding, Derby (GB)

(73) Assignee: BP CORPORATION NORTH AMERICA INC., Houston, TX (US)

( * ) Notice: Subject to any disclaimer, the term of this patent is extended or adjusted under 35 U.S.C. 154(b) by 338 days.

(21) Appl. No.: 13/996,122

(22) PCT Filed: Dec. 20, 2011

(86) PCT No.: PCT/US2011/065982

§ 371 (c)(1),
(2), (4) Date: Dec. 30, 2013

(87) PCT Pub. No.: WO2012/088013

PCT Pub. Date: Jun. 28, 2012

(65) Prior Publication Data

US 2014/0174734 A1 Jun. 26, 2014

Related U.S. Application Data

(60) Provisional application No. 61/426,103, filed on Dec. 22, 2010.

(51) Int. Cl.
*E21B 43/38* (2006.01)

(52) U.S. Cl.
CPC ..... *E21B 43/38* (2013.01)

(58) Field of Classification Search
CPC ..... E21B 43/38
See application file for complete search history.

(56) References Cited

U.S. PATENT DOCUMENTS

| | | | | |
|---|---|---|---|---|
| 4,072,481 | A | 2/1978 | Laval | |
| 5,810,081 | A | 9/1998 | Cobb et al. | |
| 6,167,960 | B1 | 1/2001 | Moya | |
| 2008/0210417 | A1 | 9/2008 | Ford | |
| 2009/0242490 | A1 | 10/2009 | Hopper | |
| 2011/0186302 | A1 * | 8/2011 | Coyle | E21B 43/128 166/372 |

FOREIGN PATENT DOCUMENTS

WO 2011079218 A2 6/2011

OTHER PUBLICATIONS

PCT Search Report and Written Opinion of the International Searching Authority issued in International Application PCT/US2011/065982, mailed Mar. 5, 2013, 25 pages.

* cited by examiner

*Primary Examiner* — William P Neuder
(74) *Attorney, Agent, or Firm* — Conley Rose, P.C.

(57) ABSTRACT

A downhole separator for separating solids from downhole well fluids comprises a cyclonic separation assembly. The assembly comprises a housing with at least one inlet port and an intake member disposed within the housing. The intake member includes a feed tube, a guide member disposed about the feed tube, and a vortex tube coaxially disposed within the feed tube. The assembly also comprises a cyclone body coaxially disposed within the housing and extending axially from the feed tube. In addition, the separator comprises an upper solids collection assembly coupled to the housing and configured to receive the separated solids from the cyclone body. Further, the separator comprises a lower solids collection assembly coupled to the housing and configured to receive the separated solids from the first solids collection assembly.

23 Claims, 9 Drawing Sheets

CYCLONIC SEPARATORS AND METHODS FOR SEPARATING PARTICULATE MATTER AND SOLIDS FROM WELL FLUIDS

CROSS-REFERENCE TO RELATED APPLICATIONS

This application is a 35 U.S.C. §371 national stage application of PCT/US2011/065982 filed Dec. 20, 2011, which claims the benefit of U.S. Provisional Application No. 61/426,103 filed Dec. 22, 2010, all of which are incorporated herein by reference in their entireties for all purposes.

STATEMENT REGARDING FEDERALLY SPONSORED RESEARCH OR DEVELOPMENT

Not applicable.

BACKGROUND

1. Field of the Invention

The invention relates generally to apparatus, systems, and methods for separating particulate matter and solids from a fluid. More particularly, the invention relates to cyclonic separators and method of using same to separate particulate matter and solids from well fluids in a downhole environment.

2. Background of the Technology

Geological structures that yield gas typically produce water and other liquids that accumulate at the bottom of the wellbore. Typically, the liquids comprise hydrocarbon condensate (e.g., relatively light gravity oil) and interstitial water in the reservoir. The liquids accumulate in the wellbore in two ways as single phase liquids that migrate into the wellbore from the surrounding reservoir, and as condensing liquids that fall back into the wellbore during production. The condensing liquids actually enter the wellbore as vapors, however, as they travel up the wellbore, their temperatures drop below their respective dew points and they phase change into liquid condensate.

In some hydrocarbon producing wells that produce both as and liquid, the formation gas pressure and volumetric flow rate are sufficient to lift the liquids to the surface. In such wells, accumulation of liquids in the wellbore generally does not hinder gas production. However, in wells where the gas phase does not provide sufficient transport energy to lift the liquids out of the well (i.e. the formation gas pressure and volumetric flow rate are not sufficient to lift the liquids to the surface), the liquid will accumulate in the well bore.

In many cases, the hydrocarbon well may initially produce gas with sufficient pressure and volumetric flow to lift produced liquids to the surface, however, over time, the produced gas pressure and volumetric flow rate decrease until they are no longer capable of lifting the produced liquids to the surface. Specifically, as the life of a natural gas well matures, reservoir pressures that drive gas production to surface decline, resulting in lower production. At some point, the gas velocities drop below the "Critical Velocity" (CV), which is the minimum velocity required to carry a droplet of water to the surface. As time progresses droplets of liquid accumulate in the bottom of the wellbore. The accumulation of liquids in the well impose an additional back-pressure on the formation that may begin to cover the gas producing portion of the formation, thereby restricting the flow of gas and detrimentally affecting the production capacity of the well. Once the liquids are no longer lifted to the surface with the produced gas, the well will eventually become "loaded" as the liquid hydrostatic head begins to overcome the lifting action of the gas flow, at which point the well is "killed" or "shuts itself in," Thus, the accumulation of liquids such as water in a natural gas well tends to reduce the quantity of natural gas which can be produced from the well. Consequently, it may become necessary to use artificial lift techniques to remove the accumulated liquid from the wellbore to restore the flow of gas from the formation into the wellbore and ultimately to the surface. The process for removing such accumulated liquids from a wellbore is commonly referred to as "deliquification."

In most cases, the accumulated liquids in the bottom of a wellbore include suspended particulate matter and solids. During downhole pumping and artificial lift operations, such solids add to the weight of the liquid that must be lifted to the surface, thereby increasing the demands placed on the lift equipment. Moreover, such solids are abrasive and may detrimentally wear components in the downhole lift equipment. Accordingly, there remains a need in the art for devices, systems, and methods for removing particulate matter and solids from accumulated downhole well liquids before lifting such liquids to the surface.

BRIEF SUMMARY OF THE DISCLOSURE

These and other needs in the art are addressed in one embodiment by a downhole separator for separating solids from downhole well fluids. In an embodiment, the separator comprises a cyclonic separation assembly. The separation assembly includes a housing with at least one inlet port. The separation assembly also includes an intake member disposed within the housing. The intake member includes a feed tube, a guide member disposed about the feed tube, and a vortex tube coaxially disposed within the feed tube. The feed tube includes an inlet port extending radially therethrough to an annulus radially positioned between the feed tube and the vortex tube. The guide member has a first end radially spaced apart from the feed tube and a second end engaging the feed tube circumferentially adjacent the inlet port of the feed tube, the guide member being configured to direct fluid flow tangentially into the annulus radially positioned between the feed tube and the vortex tub. The separation assembly further includes a cyclone body coaxially disposed within the housing and extending axially from the feed tube. The cyclone body has an inner through passage in fluid communication with the feed tube and the vortex tube. The inlet port in the housing is in fluid communication with an annulus radially positioned between the housing and the cyclone body. In addition, the separator comprises an upper solids collection assembly coupled to the housing and configured to receive the separated solids from the cyclone body. Further, the separator comprises a lower solids collection assembly coupled to the housing and configured to receive the separated solids from the first solids collection assembly.

These and other needs in the art are addressed in another embodiment by a method for deliquifying a subterranean wellbore. In an embodiment, the method comprises (a) coupling a separator to a lower end of tubing. In addition, the method comprises (b) lowering the separator into a borehole with the tubing. Further, the method comprises (c) submerging the separator in well fluids in the borehole, the well fluids comprising solids and liquids. Still further, the method comprises (d) cyclonically separating the solids from the liquids in the well fluids with the separator downhole.

These and other needs in the art are addressed in another embodiment by a downhole tool for deliquifying a wellbore. In an embodiment, the tool comprises a lift device coupled to a lower end of tubing. The lift device is configured to lift liquids in the wellbore to the surface. In addition, the tool comprises a separator coupled to the lift device. The separator comprises a cyclonic separation assembly configured to separate solids from well fluids. Further, the separator comprises a first solids collection assembly coupled to a lower end of the cyclonic separation assembly and configured to receive the separated solids from the cyclonic separation assembly. The separator also comprises a second solids collection assembly coupled to a lower end of the first solids collection assembly and configured to receive the separated solids from the first solids collection assembly.

Embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
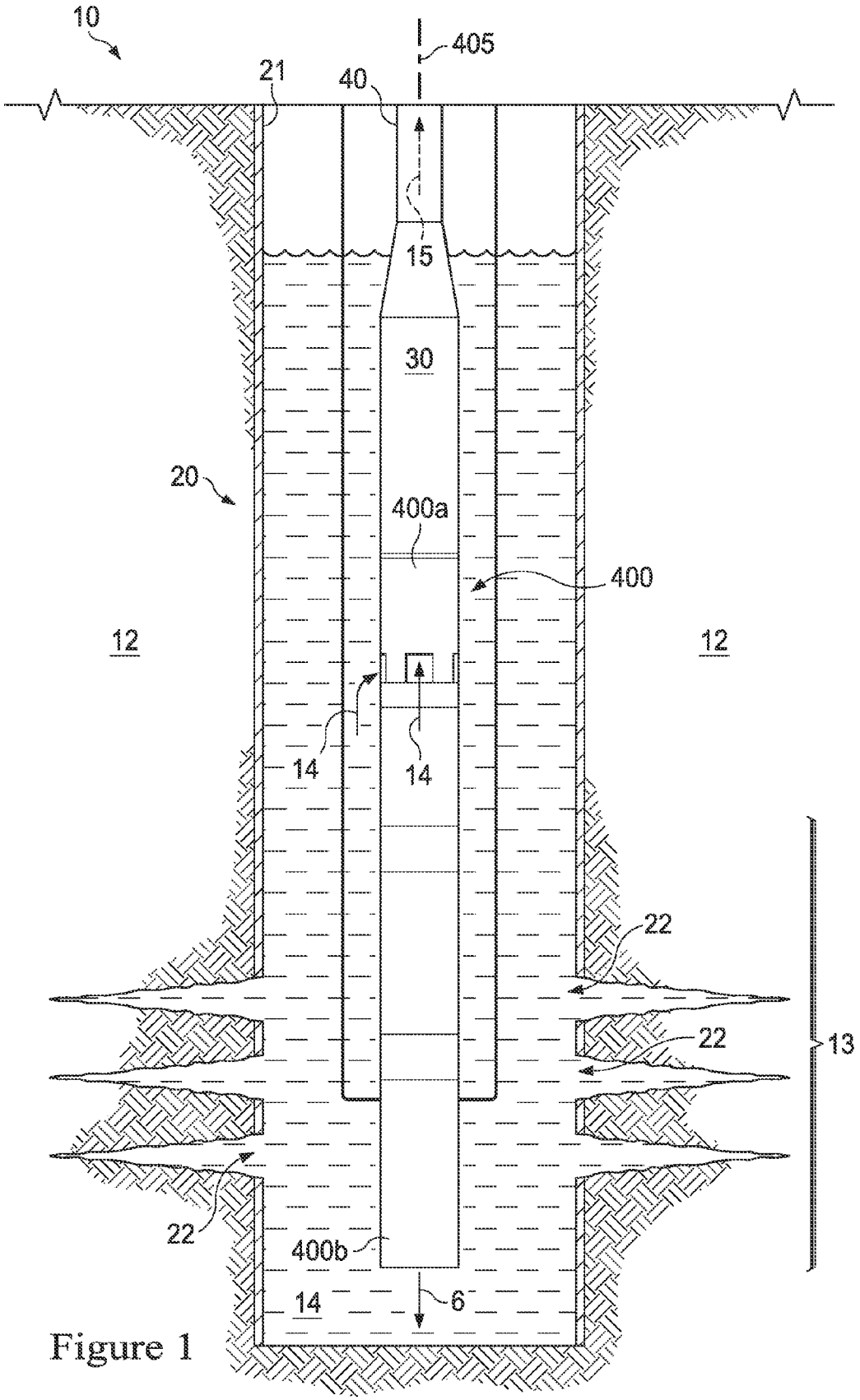
FIG. 1 is a schematic view of an embodiment of a downhole tool including an artificial lift device and a separator in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the an will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of a downhole tool or system 10 for lifting accumulated well fluids 14 from a subterranean wellbore 20 is shown. In this embodiment, system 10 includes an artificial lift device 30 and a particular matter and solids separator 400. System 10 is hung from the lower end of a tubing string or tubing 40 with a connector 45. Tubing 40 extends from the surface and is used controllably positioned system 10 at the desired depth in wellbore 20.

Wellbore 20 traverses an earthen formation 12 comprising a hydrocarbon production zone 13. Casing 21 lines wellbore 20 and includes perforations 22 that allow well fluids 14 to pass from production zone 13 into wellbore 20. In this embodiment, production tubing 23 extends from a wellhead at the surface (not shown) through wellbore casing 21 to fluids 14. System 10 and tubing 40 extend downhole through tubing 23.

Well fluids 14 may be described as "raw" or "unprocessed" since they flow directly from production zone 13 through perforations 22 into wellbore 20, and have not yet been manipulated, treated, or processed in any way. Such unprocessed well fluids 14 typically include liquids (e.g., water, oil, hydrocarbon condensates, etc.), gas (e.g. natural gas), and particulate matter and solids (e.g., sand, pieces of formation, rock chips, etc.).

During artificial lift operations, well fluids 14 in the bottom of wellbore 20 flow into separator 400, which separates at least some of the particulate matter and solids from well fluids 14 to produce processed well fluids 15 (i.e., well fluids that have been processed to reduce the amount of particulate matter and solids). Unprocessed well fluids 14 are driven into separator 400 by a pressure differential generated by lift device 30 (i.e., the fluid inlets of separator 400 are at a lower pressure than the surrounding borehole 20). The processed well fluids 15 output from separator 400 flow into artificial lift device 30, which produces well fluids 15 to the surface via tubing 40. In general, artificial lift device 30 may comprise any artificial lift device known in the art for lifting fluids to the surface including, without limitation, pumps, plungers, or combinations thereof. Although system 10 has been described in the context of a natural gas producing well, it should be appreciated that system 10 may be employed to lift and remove fluids from any type of well including, without limitation, oil producing wells, natural gas producing wells, methane producing wells, propane producing wells, or combinations thereof.

Figure 2:
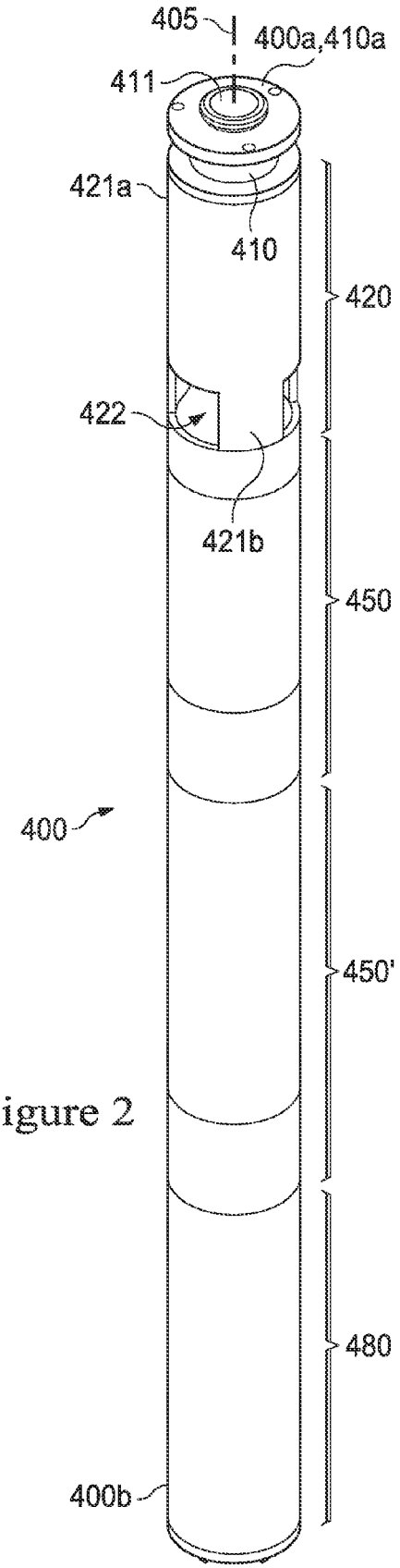
FIG. 2 is a perspective view of the separator of FIG. 1.
Figure 3:
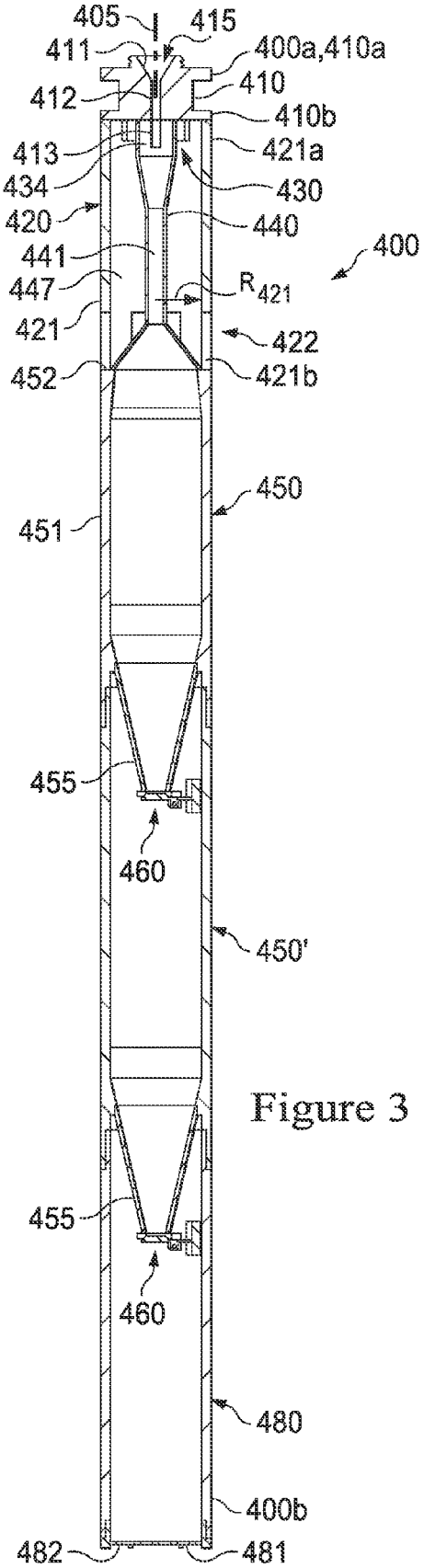
FIG. 3 is a cross-sectional view of the separator of FIG. 1.

Referring now to FIGS. 1-3, separator 400 has a central or longitudinal axis 405, a first or upper end 400*a* coupled to device 30, and a second or lower end 400*b* distal device 30. Moving axially front upper end 400*a* to lower end 400*b*, in this embodiment, separator 400 includes a coupling member 410, a cyclonic separation assembly 420, a first or upper particulate matter and solids collection assembly 450, a second or lower particulate matter and solids collection assembly 450', and a particulate matter and solids outlet tubular 480 coupled together end-to-end. Coupling member 410, cyclonic separation assembly 420, upper collection assembly 450, lower collection assembly 450', and outlet tubular 480 are coaxially aligned, each having a central axis coincident with axis 405.

Coupling member 410 connects separator 400 to artificial lift device 30, and has a first or upper end 410*a* secured to the lower end of device 30 and a second or lower end 410*b* secured to separation assembly 420. As best shown in FIG. 3, in this embodiment, coupling member 410 includes a frustoconical recess 411 extending axially from upper end 410*a*, and a throughbore 412 extending axially front recess 411 to lower end 410*b*. A vortex tube 413 in fluid communication with bore 412 extends axially downward from lower end 410*b* of coupling member 410 into separation assembly 420. Recess 411, bore 412, and tube 413 are coaxially aligned with axis 405, and together, define a flow passage 415 that extends axially through coupling member 410 and into separation assembly 420. As will be described in more detail below, during downhole lifting operations, processed well fluids 15 flow from separation assembly 420 through passage 415 into device 30, which lifts fluids 15 to the surface. Thus, passage 415 may also be referred to as a "processed fluid outlet."

Referring now to FIGS. 2 and 3, cyclonic separation assembly 420 includes a radially outer housing 421, an intake member 430, and a cyclone body 440. Tubular housing 421 has a first or upper end 421*a* secured to lower end 410*b* of coupling member 410, a second or lower end 421*b* secured to collection assembly 450, and a uniform inner radius $R_{421}$. In addition, housing 421 includes a plurality of circumferentially spaced separator inlet ports 422 at lower end 421*b*. In this embodiment, four uniformly spaced inlet ports 422 are provided. However, in other embodiments, one, two, three or more inlet ports (e.g., ports 422) may be included in the cyclone assembly housing (e.g., housing 421). As will be described in more detail below, during operation of separator 400, unprocessed well fluids 14 in wellbore 20 enter separator 400 via inlet ports 422.

Figure 4:
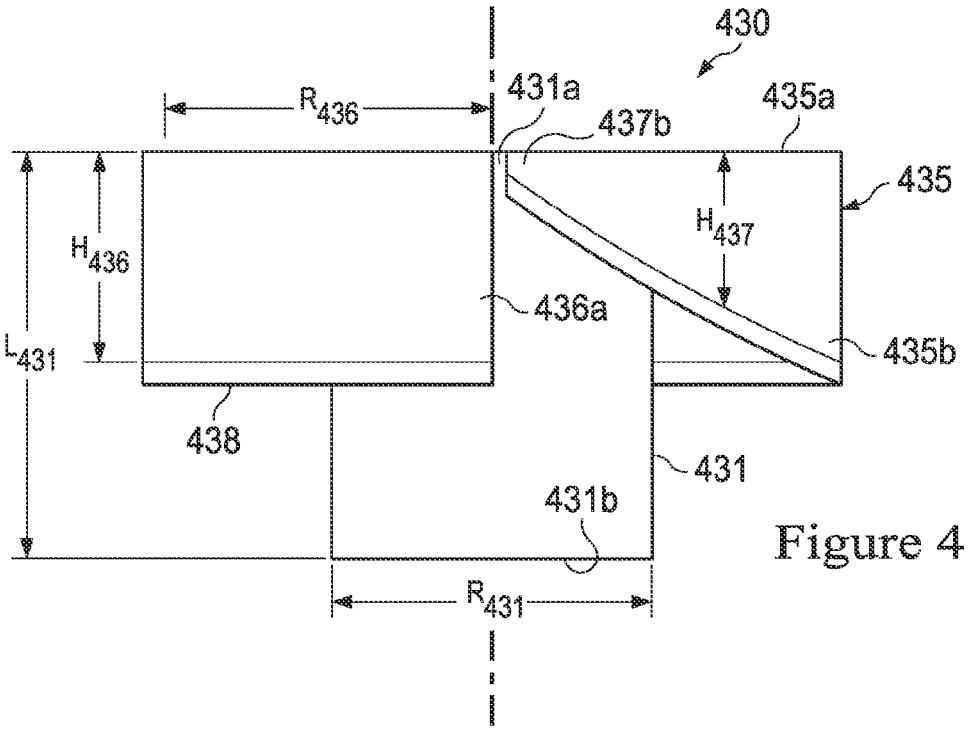
FIG. 4 is a side view of the cyclone intake of FIG. 3.
Figure 5:
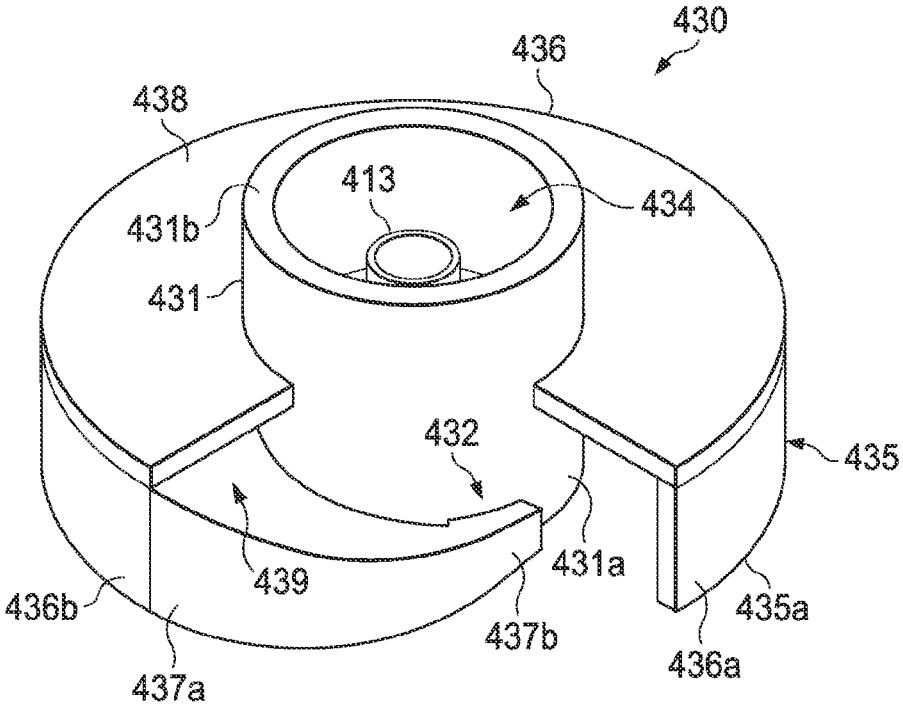
FIG. 5 is a top perspective view of the cyclone intake of FIG. 3.
Figure 6:
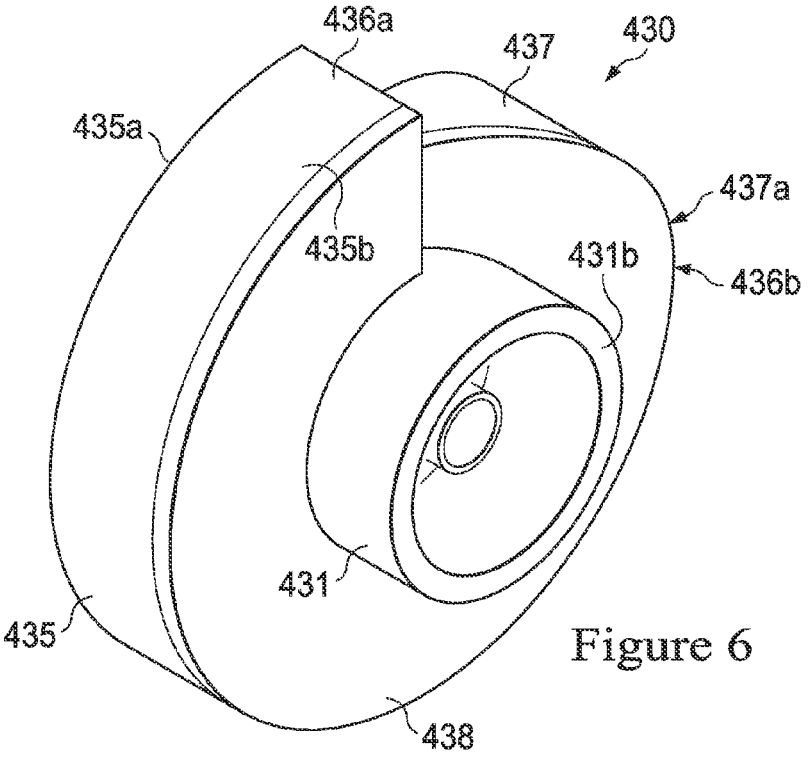
FIG. 6 is a bottom perspective view of the cyclone intake of FIG. 3.

Referring now to FIGS. 3-7, intake member 430 is coaxially disposed in upper end 421*a* of housing 421 is coupled to lower end 410*b* of member 410. In this embodiment, intake member 430 includes a feed tube 431 and an elongate fluid guide 435 disposed about feed tube 431. Feed tube 431 is coaxially aligned with and disposed about vortex tube 413. The inner radius of feed tube 431 is greater than the outer radius of vortex tube 413, and thus, an annulus 434 is positioned radially therebetween. In addition, feed tube 431 has a first or upper end 431*a* engaging lower end 410*b*, a second or lower end 431*b* distal coupling member 410, an outer radius $R_{431}$, and a length $L_{431}$ measured axially between ends 431*a, b*. As best shown in FIG. 5, feed tube 431 includes an inlet port 432 at upper end 431*a*. Port 432 extends radially through tube 431 and is in fluid communication with annulus 434.

Guide 435 has a first or upper end 435*a* engaging lower end 410*b* and a second or lower end 435*b* distal coupling member 410. In this embodiment, guide 435 is an elongate thin-walled arcuate member disposed about and oriented generally parallel to feed tube 431. In particular, guide 435 has a first circumferential section or segment 436 disposed at a uniform radius $R_{436}$ that is greater than radius $R_{431}$ of feed tube 431, and a second circumferential section or segment 437 extending from first segment 436 and curving radially inward to feed tube 431. Thus, guide 435 is disposed about feed tube 431 and may be described as spiraling radially inward to feed tube 431.

Referring again to FIGS. 3-7, second segment 437 has a first end 437*a* contiguous with second end 436*b* of first segment 436 and a second end 437*b* that engages feed tube 431. Thus, first end 437*a* is disposed at radius $R_{436}$, however, second end 437*b* is disposed at radius $R_{431}$. Consequently, moving from end 437*a* to end 437*b*, second segment 437 curves radially inward toward feed tube 431. First end 437*a* is circumferentially positioned to one side of inlet port 436, and second end 437*b* is circumferentially positioned on the opposite side of inlet port 436. Thus, second segment 437 extends circumferentially across inlet port 436.

Figure 7:
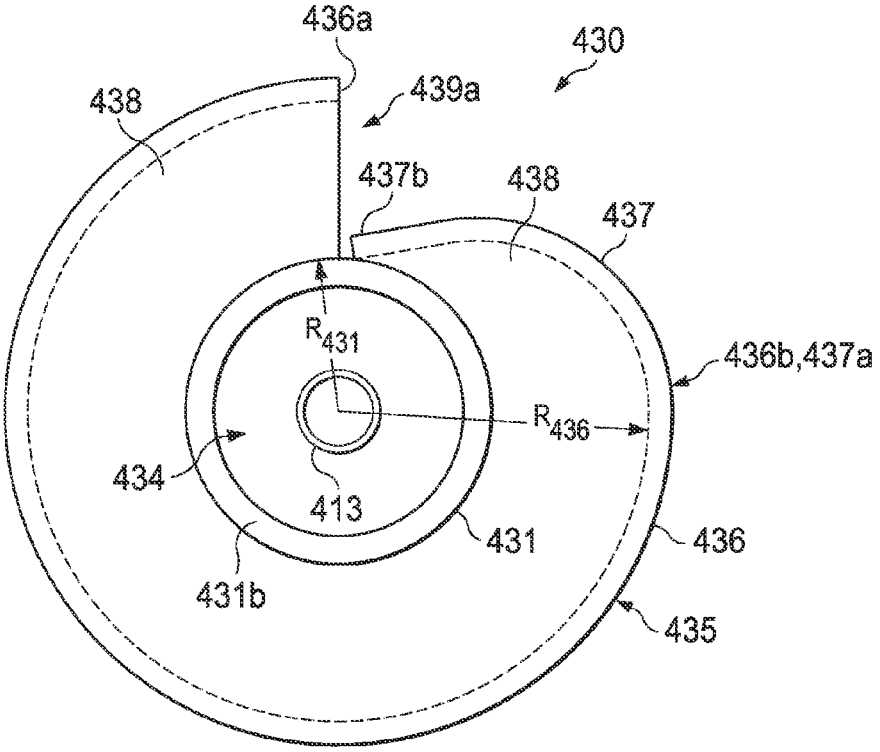
FIG. 7 is a bottom view of the cyclone intake of FIG. 3.

As best shown in FIG. 7, first end 437*b* is contiguous with second end 436*b*, and second end 437*b* is circumferentially adjacent first end 436*a*, albeit position radially inward of first end 436*a*. Consequently, guide 435 extends circumferentially about the entire feed tube 431. In particular, first segment 436 extends circumferentially through an angle of about 270° between a first end 436*a* and a second end 436*b*, and second segment 437 extends circumferentially through an angle of about 90° between first end 437*a* and second end 437*b*. Thus, segment 436 extends about 75% of the circumference of feed tribe 431, and segment 437 extends about 25% of the circumference of feed tube 431.

Referring now to FIGS. 4-7, a base member 438 extends radially from lower end 435*b* of guide 435 to feed tube 431. Together, guide 435, base member 438, feed tube 431, and lower end 410*b* of coupling member define a spiral flow passage 439 within intake member 430. Flow passage 439 extends from an inlet 439*a* at end 436*a* to feed tube port 432 at end 437*b*. In FIG. 5, the portion of base member 438 extending radially between section 437 and feed tube 431 has been omitted to more clearly illustrate port 432.

As best shown in FIG. 4, first segment 436 has a uniform height $H_{436}$ measured axially from upper end 435*a* to base member 438, and second segment 437 has a variable height $H_{437}$ measured axially from upper end 435*a* to base member 438. Thus, between ends 436*a,b* of first segment 436, base member 438 is generally flat, however, moving from end 437*a* to end 437*b* of second segment 437, base member 438 curves upward. Height $H_{436}$ is less than height $H_{431}$, and thus, feed tube 431 extends axially downward from guide 435. Further, in this embodiment, height $H_{437}$ is equal to height $H_{436}$ at end 437*a*, but linearly decreases moving from end 437*a* to end 437*b*. The decrease in height $H_{437}$ moving from end 437*a* to end 437*b* causes fluid flow through passage 439 to accelerate into port 432.

Referring again to FIGS. 2 and 3, during operation of separator 400, well fluids 14 enter housing 421 through separator inlet ports 422, and flow axially upward within housing 421 and into passage 439 of cyclone intake member 430 via inlet 439*a*. Flow passage 439 guides well fluids 14 circumferentially about feed tube 431 toward feed tube port 432. As the radial distance between guide 435 and feed tube 431, as well as the axial distance between base member 438 and upper end 435*a*, decrease along second segment 437, well fluids 14 in passage 439 are accelerated and directed through feed tube port 432 into feed tube 431. As best shown in FIG. 7, second segment 437 is oriented generally tangent to feed tube 431. Thus, second segment 437 directs well fluids 14 "tangentially" through port 432 into feed tube 431 (i.e., in a direction generally tangent to the radially inner surface of feed tube 431 at port 432). This configuration facilitates the formation of a spiraling or cyclonic fluid flow within feed tube 431. Vortex tube 413 extending coaxially axially through feed tube 431 is configured and positioned to enhance the formation of a vortex and resulting cyclonic fluid flow within feed tube 431. In particular, the coaxial placement of vortex tube 413 within feed tube 431 facilitates the circumferential flow of fluids 14 within annulus 434.

Figure 8:
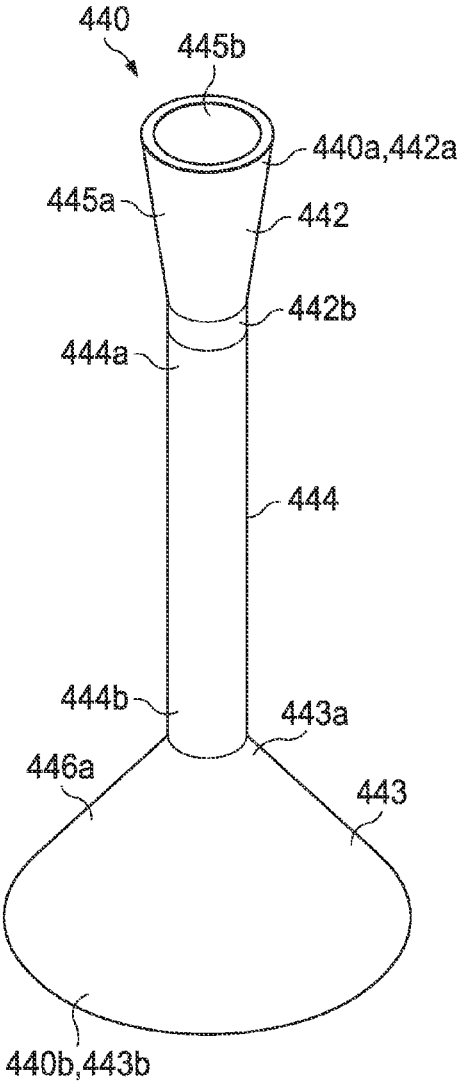
FIG. 8 is a perspective view of the separator cyclone of FIG. 3.
Figure 9:
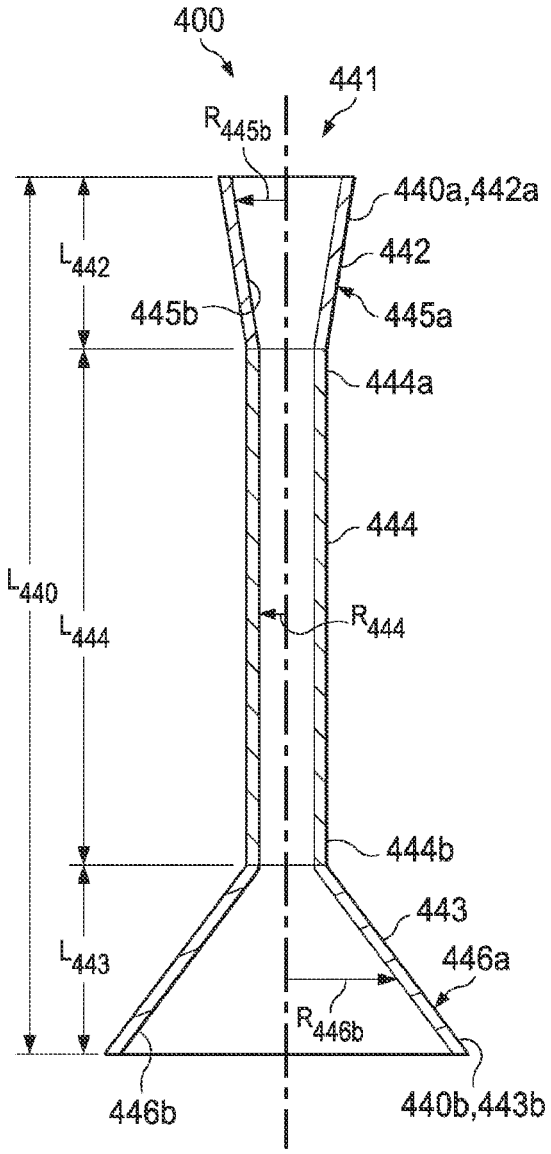
FIG. 9 is a cross-sectional view of the separator cyclone of FIG. 3.

Referring now to FIGS. 3, 8, and 9, cyclone body 440 is coaxially disposed in housing 421 and extends axially from lower end 431*b* of feed tube 431. Cyclone body 440 has a first or upper end 440*a* engaging lower end 431*b* of feed tube 431, a second or lower end 440*b* distal feed tube 431, a central flow passage 441 extending axially between ends 440*a, b*, and a length $L_{440}$ measured axially between ends 440*a, b*. Lower end 440*b* is axially aligned with housing lower end 421*b* and extends radially outward to housing lower end 421*b*. The remainder of cyclone body 440 is radially spaced from housing 421, thereby defining an annulus 447 radially disposed between cyclone body 440 and housing 421.

In this embodiment, cyclone body 440 includes an upper converging member or conical funnel 442 at end 440*a*, a lower diverging member or inverted conical funnel 443 at end 440*b*, and an intermediate tubular member 444 extending axially between funnels 442, 443. Funnels 442, 443 have first or upper ends 442*a*, 443*a*, respectively, and second or lower ends 442*b*, 443*b*, respectively. Further, tubular member 444 has a first or upper end 444*a* coupled to lower end 442*b* and a second or lower end 444*b* coupled to upper end 443*a*.

Tubular member 444 has a length $L_{444}$ measured axially between ends 444*a, b*, and a constant or uniform inner radius $R_{444}$ along its entire length $L_{444}$. Funnel 442 has a frustoconical radially outer surface 445*a*, a frustoconical radially inner surface 445*b* that is parallel to surface 445*a*. In addition, funnel 442 has a length $L_{442}$ measured axially between ends 442*a, b*, and an inner radius $R_{445b}$ that decreases linearly moving downward from end 442*a* to end 442*b*. In particular, radius $R_{445b}$ is equal to inner radius of feed tube 431 at upper end 442*a*, and equal to inner radius $R_{444}$ of tubular member 444 at end 442*b*. Thus, as fluid flows axially downward through cyclone body 440, funnel 442 functions as a converging nozzle.

Lower funnel 443 has a frustoconical radially outer surface 446*a* and a frustoconical radially inner surface 446*b* that is parallel to surface 446*a*. In addition, diverging member 443 has a length $L_{443}$ measured axially between ends 443*a, b*, and an inner radius $R_{446b}$ that increases linearly moving downward from end 443*a* to end 443*b*. In particular, radius $R_{446b}$ is equal to inner radius $R_{431}$ of feed tube 431 at upper end 443*a*, and slightly less than inner radius $R_{421}$ of housing 421 at end 443*b*. Thus, as fluid flows axially downward through cyclone body 440, funnel 443 functions as a diverging nozzle. The dimensions of funnels 442, 443 and tubular member 444 may be tailored to achieve the desired cyclonic fluid flow through cyclone body 440.

Figure 10:
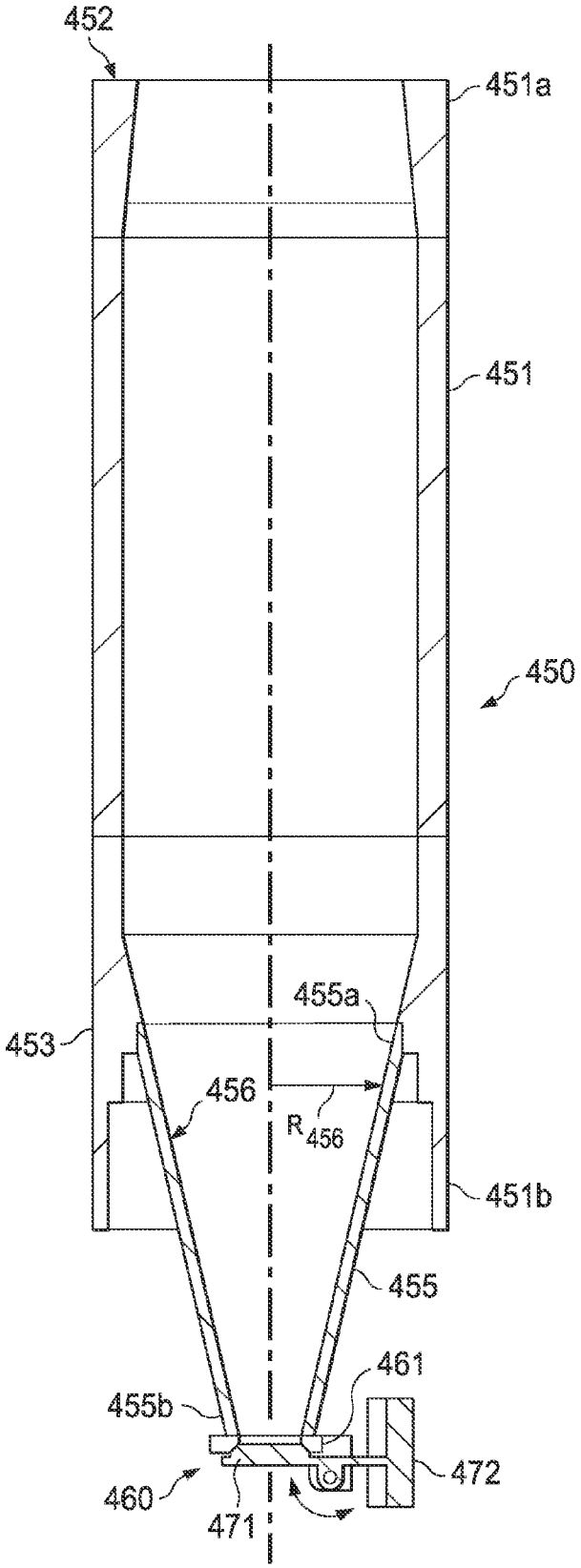
FIG. 10 is an enlarged cross-sectional view of one of the solids collection assemblies of FIG. 3.

Referring now to FIGS. 3 and 10, upper collection assembly 450 includes a generally tubular housing 451, a funnel 455 coaxially disposed within housing 451, and a trap door assembly 460 coupled to funnel 455. Housing 451 has a first or upper end 451*a* coupled to lower end 421*b* of cyclone housing 421 and a second or lower end 451*b* coupled to lower collection assembly 450'. In this embodiment, housing 451 is formed from a plurality of tubular member coaxially coupled together end-to-end. Upper end 451*a* defines an upward facing annular shoulder 452 that extends radially inward relative to lower end 421*b* of cyclone housing 421. Shoulder 452 axially abuts and engages lower end 440*b* of cyclone body 440, thereby supporting body 440 within housing 421. Housing 451 also includes a downward facing radially inner annular shoulder 453 axially positioned between ends 451*a, b*.

Funnel 455 has an upper end 455*a*, a lower end 455*b* opposite end 455*a*, and a frustoconical radially inner surface 456 extending between ends 455*a, b*. Upper end 455*a* axial abuts and engages annular shoulder 453, and lower end 455*b* extends axially from housing 451. In other words, funnel lower end 455*b* is disposed axially below housing lower end 451*b*. Inner surface 456 is disposed at a radius $R_{456}$ that decreases moving axially downward from end 455*a* to end 455*b*.

Figure 11:
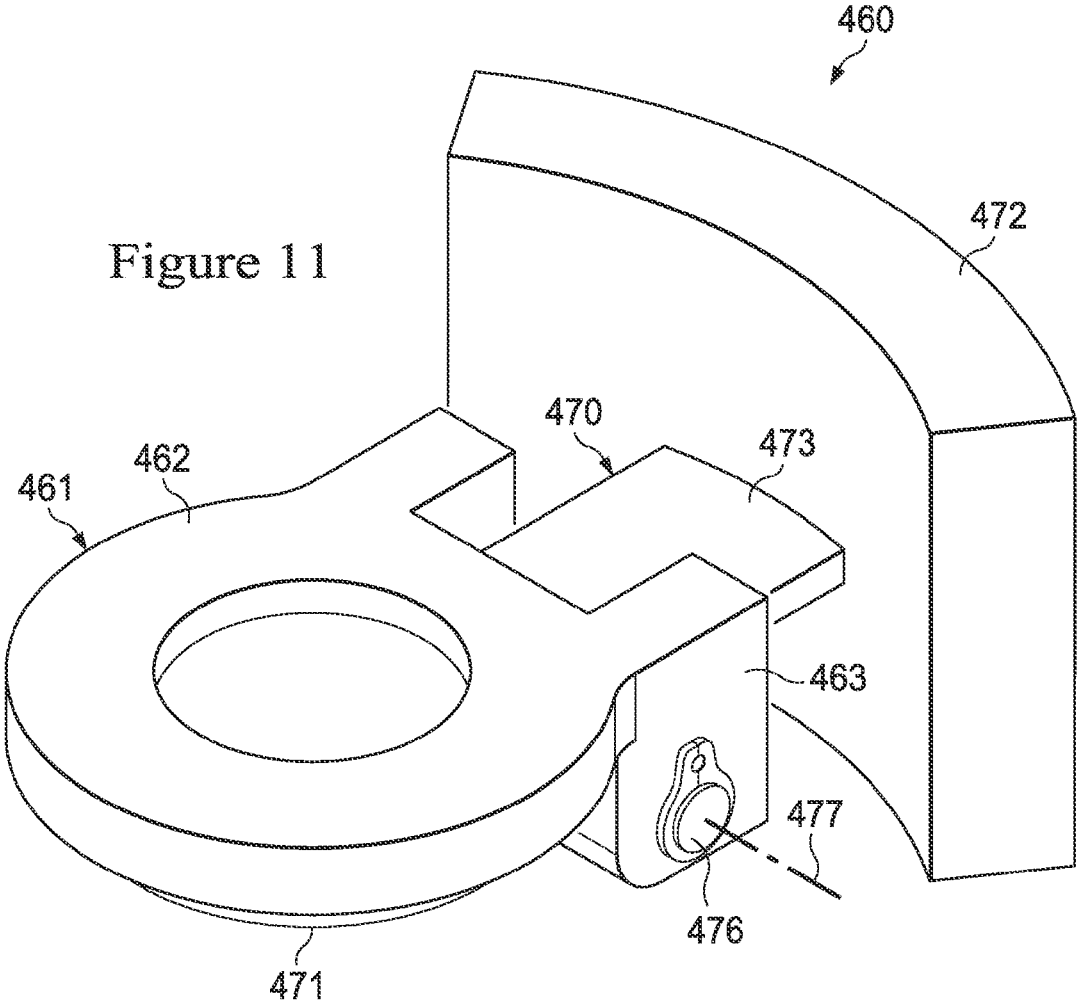
FIG. 11 is an enlarged perspective view of the trap door assembly of FIG. 10.
Figure 12:
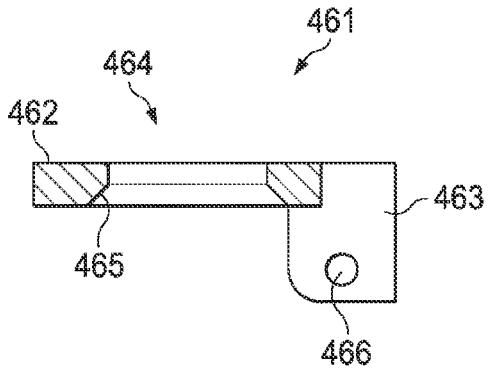
FIG. 12 is a cross-sectional side view of the base member of the trap door assembly of FIG. 11.
Figure 13:
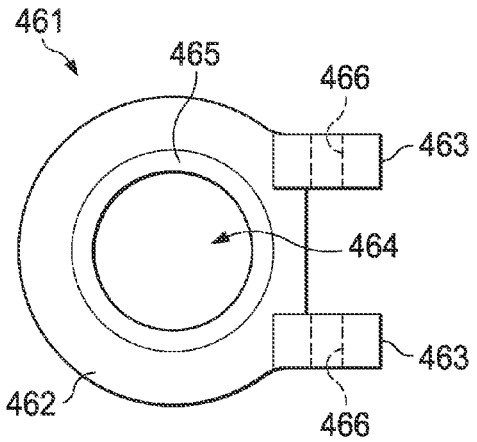
FIG. 13 is a bottom view of the base member of the trap door assembly of FIG. 11.

Referring now to FIGS. 10-15, trap door assembly 460 includes base member 461 secured to lower end 455*b* of funnel 455 and a rotating member or door 470 rotatably coupled to base member 461. Base member 461 is fixed to funnel 455 such that it does not move translationally or rotationally relative to funnel 455. However, door 470 is rotatably coupled to base 461, and thus, door 470 can rotate relative to base 461 and funnel 455. As best shown in FIGS. 11-13, base member 461 comprises an annular flange 462 and a pair of circumferentially spaced parallel arms 463 extending axially downward from flange 462. Flange 462 is fixed to lower end 455*b* of funnel 455 and has a throughbore 464 aligned with funnel 455. Bore 464 includes an annular shoulder or seat 465. Arms 463 are positioned radially outward of bore 464 and include aligned holes 466.

Figure 14:
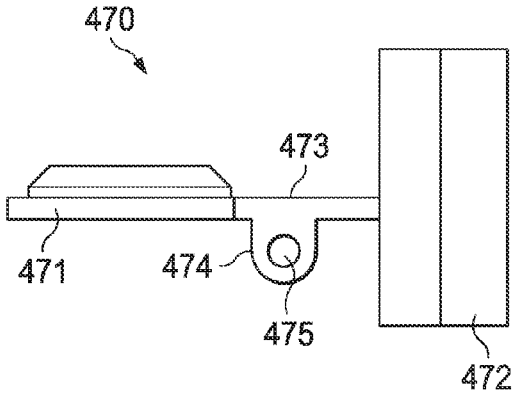
FIG. 14 is a side view of the rotating member of the trap door assembly of FIG. 11.
Figure 15:
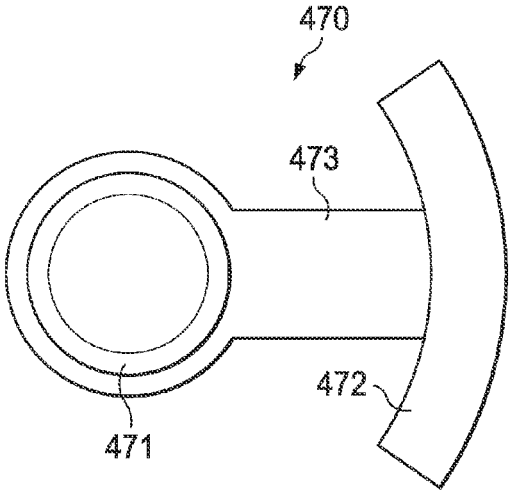
FIG. 15 is a top view of the rotating member of the trap door assembly of FIG. 11.

As best shown in FIGS. 11, 14, and 15, door 470 comprises an annular plug 471 and a counterweight 472 connected to plug 471 with a lever arm 473. Plug 471 is adapted to move into and out of engagement with seat 465, thereby closing and opening bore 464, respectively. In particular, a pair of parallel arms 474 extend downward from lever arm 473 and include aligned holes 475. Lever arm 473 is positioned between arms 463 of base member 461, holes 466, 475 are aligned, and plug 471 is positioned immediately below flange 462. A shaft 476 having a central axis 477 extends through holes 466, 475, thereby rotatably coupling door 470 to base member 461.

Referring again to FIGS. 10 and 11, door 470 is allowed to rotate relative to base member 461 about shaft axis 477, thereby moving plug 471 into and out of engagement with seat 465 and transitioning door 470 and assembly 460 between a "closed" and an "opened" position. In particular, when trap door assembly 460 and door 470 are closed, plug 471 engages seat 465, thereby obstructing bore 464 and restricting and/or preventing movement of fluids and solids between collection assemblies 450, 450'. However, when trap door assembly 460 and door 470 are opened, plug 471 is swung downward out of engagement with seat 465, thereby allowing movement of fluids and solids between collection assemblies 450, 450'. In this embodiment, counterweight 472 biases plug 471 to the closed position engaging seat 465, however, if a vertically downward load applied to plug 471 is sufficient to overcome counterweight 472, door 470 will rotate about axis 477 and swing plug 471 downward and out of engagement with seat 465.

Referring again to FIGS. 3 and 10, lower collection assembly 450' is coupled to lower end 451*b* of upper collection assembly housing 451. In this embodiment, lower collection assembly 450' is substantially the same as upper collection assembly 450. Namely, lower collection assembly 450' includes a tubular housing 451, a funnel 455, a trap door assembly 460. Housing 451, funnel 455, and trap door assembly 460 of lower solids collection assembly 450' are each as previously described with the exception that upper end 451*a* of housing 451 of lower collection assembly 450' does not extend radially inward relative to the remainder of housing 451 of lower collection assembly 450', and counterweight 472 of lower collection assembly 450' has a different weight than counterweight 472 of upper collection assembly 450. In particular, counterweight 472 of lower collection assembly 450' weighs more than counterweight 472 of upper collection assembly 450. Consequently, trap door assemblies 460 of collection assemblies 450, 450' are generally designed not to be open at the same time (i.e., when trap door assembly 460 of assembly 450 is open, trap door assembly 460 of assembly 450' is closed, and vice versa).

Referring now to FIGS. 2 and 3, particulate matter and solids outlet tubular 480 is coupled to lower end 451*b* of housing 451 of lower collection assembly 450' and extends axially downward to lower end 400*b* of separator 400. In this embodiment, a screen 481 including a plurality of holes 482 is coupled to tubular 480 at lower end 480. Holes 482 allows separated solids that pass through lower collection assembly 450' into tubular 480 to fall under the force of gravity from lower end 400*b* of separator 400. In other embodiments, screen 481 may be omitted.

Figure 16:
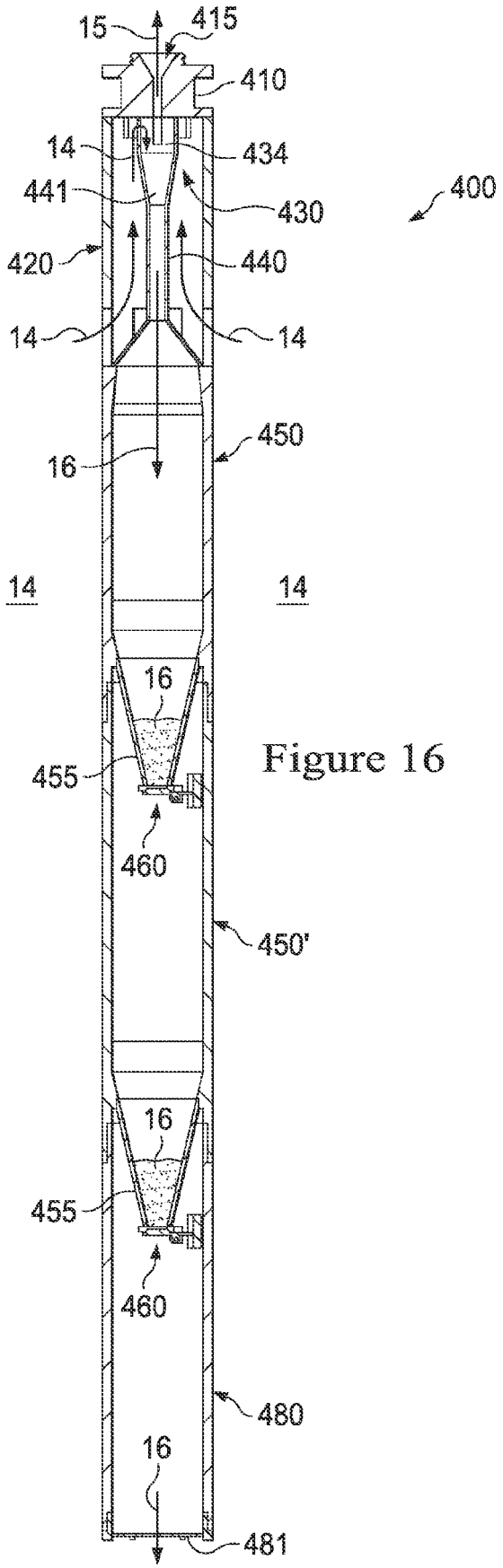
FIG. 16 is a cross-sectional view of the separator of FIG. 1 schematically illustrating the operation of the separator of FIG. 1.

Referring now to FIGS. 3 and 16, the operation of separator 400 to remove particulate matter and solids from unprocessed reservoir fluids 14 to generate processed fluids 15 will now be described. The processed fluids 15 output by separator 400 are flowed to the surface with artificial lift device 30. In this embodiment, system 10 is coupled to the lower end of tubing 40 and lowered downhole. System 10 is preferably lowered downhole: until inlet ports 422 of separator 400 are completely submerged in well fluids 14. As a result, separator 400 is initially filled and surrounded by well fluids 14.

Next, lift device 30 is operated to begin downhole lifting operations. For example, in embodiments where device 30 is a downhole pump, device 30 begins pumping well fluids to the surface. Such lifting operations generate a relatively low pressure region within passage 415 as lift device 30 pulls well fluids from separator 400 through passage 415, which is in fluid communication with inner passage 441, annulus 434, and annulus 447 (via feed tube port 432). Thus, the low pressure region in passage 415 generally seeks to (a) pull well fluids 14 in passage 441 upward into vortex tube 413 and passage 415; (b) pull well fluids 14 in annulus 434 axially downward toward into lower end of vortex tube 413; and (c) pull well fluids in annulus 447 axially upward to port 432. Well fluids 14 in annulus 447 can be pulled through port 432 and annulus 434 into vortex tube 413, however, well fluids 14 in passage 441 of cyclone body 440 axially below feed tube 431 are restricted and/or prevented from being pulled axially upward into vortex tube 413 as long as trap door assembly 460 of upper collection assembly 450 or trap door assembly 460 of lower collection assembly 450' is closed. In particular, when trap door assembly 460 of upper collection assembly 450 is closed, upper collection assembly 450 functions like a sealed tank suction of any well fluids 14 upward from collection assembly 450 wilt result in formation of a relatively low pressure region in collection assembly 450 that restricts and/or prevents further suction of well fluids 14 from collection assembly 450; and when trap door assembly 460 of upper collection assembly 450 is open and trap door assembly 460 of lower collection assembly 450' is closed, collection assemblies 450, 450' function together like a seal tank—suction of any well fluids 14 upward from either collection assembly 450, 450' will result in formation of a relatively low pressure region therein that restricts and/or prevents further suction of well fluids 14 from collection assemblies 450, 450'. As will be described in more detail below, in embodiments described herein, trap door assemblies 460 of collection assemblies 450, 450' are configured such that at least one trap door assembly 460 is closed at any given time, thereby restricting and/or preventing well fluids 14 in passage 441 of cyclone body 440 axially below feed tube 431 from being pulled axially upward into vortex tube 413 during operation of device 30 and separator 400.

Referring still to FIG. 16, the relatively low pressure region in passage 415 causes unprocessed well fluids 14 to flow into cyclonic separation assembly 420 via inlet ports 422. Upon entering cyclonic separation assembly 420, well fluids 14 flow axially upward within annulus 447 to cyclone, intake member 430 and enter spiral flow passage 439 at inlet 439*a* of intake member 430. Within passage 439, well fluids 14 flow circumferentially about feed tube 431 toward feed tube inlet port 432, and are accelerated within passage 439 as they approach port 432. At outlet 439*b*, well fluids 14 flow through port 432 tangentially into feed tube 431 and are partially aided by vortex tube 413 to form a cyclonic or spiral flow pattern within feed tube 431. As well fluids 14 spiral within feed tube 431, they also move axially downward towards the lower end of vortex tube 413 under the influence of the low pressure region in passage 415.

The solids and particulate matter in well fluids 14 with sufficient inertia, designated with reference numeral 16, begin to separate from the liquid and gaseous phases in well fluids 14 and move radially outward towards the radially inner surface of feed tube 431. Eventually solids 16 strike the inner surface of feed tube 431 and fall under the force of gravity into funnel 442. The liquid and gaseous phases in well fluids 14, as well as the relatively low inertia particles remaining therein, collectively referred to as processed well fluids 15, continue their cyclonic flow in feed tube 431 as they move towards the lower end of vortex tube 413. When processed well fluids 15 reach the lower end of vortex tube 413, they are pulled into tube 413, through passage 415, and are ejected into device 30. As previously described, device 30 then lifts processed fluids 15 to the surface.

After being separated from unprocessed well fluids 14, solids 16 fall through passage 441 of cyclone body 440 under the force of gravity into upper collection assembly 450. Solids 16 falling through housing 451 of upper collection assembly 450 are guided by funnel 455 to throughbore 464. Door 470 is biased to the closed position by the corresponding counterweight 472, and thus, closes off throughbore 464, thereby restricting and/or preventing solids 16 from falling through bore 464 into lower collection assembly 450'. However, as solids 16 continue to accumulate on plug 471, they exert an increasing load/weight on plug 471. When a sufficient quantity of solids 16 have accumulated on plug 471, the load/weight of the solids 16 overcomes the biasing force generated by counterweight 472 and transitions door 470 to the open position allowing solids 16 to fall through bore 464 into lower collection assembly 450. Once a sufficient quantity of solids 16 have exited upper collection assembly 450 through bore 464, counterweight 472 biases door 470 back to the closed position and solids 16 once again begin to accumulate on plug 471.

Solids 16 passing through bore 464 of upper collection assembly 450 (when the associated door 470 opens) fall under the force of gravity through housing 451 and funnel 455 of lower collection assembly 450. Similar to upper collection assembly 450 previously described, door 470 of lower collection assembly 450 is biased to the closed position by the corresponding counterweight 472, and thus, closes off throughbore 464, thereby restricting and/or preventing solids 16 from exiting lower collection assembly 450. However, as solids 16 continue to accumulate on plug 471, they exert an increasing load/weight on plug 471. When a sufficient quantity of solids 16 have accumulated on plug 471 of lower collection assembly 450, the load/weight of the solids 16 overcomes the biasing force generated by counterweight 472 and transitions door 470 to the open position allowing solids 16 to fall through bore 464 into outlet tubular 480. Once a sufficient quantity of solids 16 have exited lower collection assembly 450' through bore 464, counterweight 472 biases door 470 back to the closed position and solids 16 once again begin to accumulate on plug 471. Solids 16 in outlet tubular 480 continue to fall downward and pass through holes 482 in screen 481, thereby exciting separator 400.

In the manner described, unprocessed well fluids 14 are fed into separator 400. Particulate matter and solids 16 are separated from well fluids 14 with cyclonic separation assembly 420 to form processed well fluids 15 (i.e., unprocessed well fluids 14 minus particulate matter and solids 16). Processed well fluids 15 are pulled through passage 415 into lift device 30, which produces processed well fluids 15 to the surface. Solids 16 separated from well fluids 14 fall downward under their own weight into upper collection assembly 450, then into lower collection assembly 450, and finally through outlet tubular 480, thereby exiting separator 400. This process is performed in a continuous fashion to separate solids 16 from well fluids 14 prior to lifting processed well fluids 15 to the surface with lift device 30. By separating out all of substantially all of solids 16 from well fluids 14 before lifting well fluids 15 to the surface, separator 400 offers the potential to reduce the load demands on lift device 30 and the abrasive wear and tear of lift device 30.

Disruption of the cyclonic flow of well fluids 14 within feed tube 431 may negatively impact the ability of cyclonic separation assembly 420 to separate solids 16 from well fluids 14. However, the use of two trap door assemblies 460 with different counterweights 472 in a serial arrangement offers the potential to minimize the impact on the cyclonic flow of fluids 14 within feed tube 431 as solids 16 are separated and ultimately expelled from separator 400 via outlet tubular 480. For example, if the weight of counterweight 472 of the lower solids collection assembly 450' is twice the weight of counterweight 472 of the upper solids collection assembly 450, the weight of accumulated solids 16 necessary to transition door 470 of lower solids collection assembly 450' to the open position is twice the weight of accumulated solids 16 necessary to transition door 470 of upper solids collection assembly 450 to the open position. Accordingly, upper solids collection assembly 450 will drop about two loads of accumulated solids 16 into lower solids collection assembly 450' before lower solids collection assembly 450 drops one load of accumulated solids 16 into outlet tubular 480. By the time the second load of accumulated solids 16 dropped from upper solids collection assembly 450 settles in funnel 455 of lower solids collection assembly 450' and transitions door 470 of lower solids collection assembly 450 to the open position, door 470 of upper solids collection assembly 450 has transitioned back to the closed position.

In general, the various parts and components of separator 400 may be fabricated from any suitable material(s) including, without limitation, metals and metal alloys (e.g., aluminum, steel, inconel, etc.), non-metals (e.g., polymers, rubbers, ceramics, etc.), composites (e.g., carbon fiber and epoxy matrix composites, etc.), or combinations thereof. However, the components of separator 400 are preferably made from durable, corrosion resistant materials suitable for use in harsh downhole conditions such steel.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simply subsequent reference to such steps.

What is claimed is:

1. A downhole separator for separating solids from downhole well fluids, the separator having a central axis and comprising:

a cyclonic separation assembly, including:

a housing with at least one inlet port;

an intake member disposed within the housing, wherein the intake member includes a feed tube, a guide member disposed about the feed tube, and a vortex tube coaxially disposed within the feed tube;

wherein the feed tube includes an inlet port extending radially therethrough to an annulus radially positioned between the feed tube and the vortex tube;

wherein the guide member has a first end radially spaced apart from the feed tube and a second end engaging the feed tube circumferentially adjacent the inlet port of the feed tube, the guide member being configured to direct fluid flow tangentially into the annulus radially positioned between the feed tube and the vortex tube;

a cyclone body coaxially disposed within the housing and extending axially from the feed tube, the cyclone body having an inner through passage in fluid communication with the feed tube and the vortex tube;

wherein the inlet port in the housing is in fluid communication with an annulus radially positioned between the housing and the cyclone body;

an upper solids collection assembly coupled to the housing and configured to receive the separated solids from the cyclone body; and a lower solids collection assembly coupled to the housing and configured to receive the separated solids from the first solids collection assembly.

2. The separator of claim 1, wherein the guide member spirals about the feed tube.

3. The separator of claim 1, wherein the cyclone body has an upper end engaging the feed tube and a lower end distal the feed tube; and wherein the cyclone body includes an upper funnel extending from the upper end, a lower inverted funnel extending from the lower end, and a tubular member extending between the upper funnel and the lower funnel.

4. The separator of claim 3, wherein the upper funnel is radially spaced from the housing and the lower funnel engages the housing at the lower end of the cyclone body.

5. The separator of claim 1, wherein the upper solids collection assembly and the lower solids collection assembly each comprise:

a housing;

a funnel at least partially disposed within the housing; and a door assembly coupled to a lower end of the corresponding funnel.

6. The separator of claim 5, wherein the housing of the upper solids collection assembly is coupled to a lower end of the housing cyclonic separation assembly, and wherein the housing of the lower solids collection assembly is coupled to a lower end of the housing of the upper solids collection assembly.

7. The separator of claim 5, wherein each door assembly includes a base member having a throughbore and a door rotatably coupled to the corresponding base member, wherein each base member is fixed to the lower end of the corresponding funnel.

8. The separator of claim 7, wherein each door has an open position allowing the separated solids to fall through the corresponding funnel, and a closed position restricting the separated solids from falling through the corresponding funnel.

9. The separator of claim 7, wherein each door comprises an annular plug and a counterweight connected to the plug with a lever arm, wherein the plug is seated in the throughbore of the corresponding base member in the closed position and is removed from the throughbore of the corresponding base member in the open position.

10. The separator of claim 9, wherein the counterweight of the upper solids collection assembly has a first weight and the counterweight of the lower solids collection assembly has a second weight that is different than the first weight.

11. A method for deliquifying a subterranean wellbore, comprising:

(a) coupling a separator to a lower end of tubing;

(b) lowering the separator into a borehole with the tubing;

(c) submerging the separator in well fluids in the borehole, the well fluids comprising solids and liquids; and (d) cyclonically separating the solids from the liquids in the well fluids with the separator downhole;

(e) allowing the separated solids to fall into a first solids collection assembly after (d);

(f) allowing the separated solids in the first solids collection assembly to fall from the first solids collection assembly into a second solids collection assembly after the separated solids in the first solids collection assembly exceed a first weight;

(g) allowing the separated solids in the second solids collection assembly to fall from the second solids collection assembly after the separated solids in the second solids collection assembly exceed a second weight that is different from the first weight.

12. The method of claim 11, further comprising:

coupling a lift device to the separator;

lowering the lift device into the borehole with the tubing during (b);

flowing the liquids to the lift device after (d); and lifting the liquids to the surface with the lift device.

13. The method of claim 11, wherein the separator comprises:

a cyclonic separation assembly, including:

an annular housing including an inlet port;

an intake member disposed within the housing, wherein the intake member includes a feed tube, a guide member disposed about the feed tube, and a vortex tube coaxially disposed within the feed tube;

wherein the feed tube includes an inlet port in fluid communication with a first annulus positioned radially between the feed tube and the vortex tube and a flow passage positioned radially between the guide member and the feed tube;

wherein the vortex tube extends axially from a lower end of the feed tube;

a cyclone body disposed within the housing and extending axially from the feed tube, the cyclone body having an inner through passage in fluid communication with the feed tube and the vortex tube.

14. The method of claim 13, wherein (d) comprises:

(d1) flowing the well fluids through the inlet port of the housing;

(d2) flowing the well fluids into the flow passage;

(d3) accelerating the well fluids flowing through the flow passage during (d2);

(d4) flowing the well fluids through the inlet port of the feed tube and tangentially into first annulus; and (d5) flowing the well fluids cyclonically within the first annulus.

15. The method of claim 14, wherein (d5) further comprises separating the solids from the liquids in the well fluids.

16. The method of claim 14, wherein (e) comprises allowing the separated solids to fall from the first annulus through the through passage in the cyclone body into the first solids collection assembly after (d5).

17. The method of claim 16, wherein each solids collection assembly comprises:

a housing;

a funnel at least partially disposed within the housing; and a door assembly coupled to a lower end of the corresponding funnel;

wherein (f) comprises transitioning the door assembly of the first solids collection assembly from a closed position to an opened position, and allowing the separated solids to move through the funnel of the first solids collection assembly into the second solids collection assembly;

wherein (g) comprises transitioning the door assembly of the second solids collection assembly from a closed position to an opened position, and allowing the separated solids to move through the funnel of the first solids collection assembly.

18. A downhole tool for deliquifying a wellbore comprising:

a lift device coupled to a lower end of tubing, wherein the lift device is configured to lift liquids in the wellbore to the surface;

a separator coupled to the lift device, wherein the separator comprises:

a cyclonic separation assembly configured to separate solids from well fluids;

a first solids collection assembly coupled to a lower end of the cyclonic separation assembly and configured to receive the separated solids from the cyclonic separation assembly; and a second solids collection assembly coupled to a lower end of the first solids collection assembly and configured to receive the separated solids from the first solids collection assembly.

19. The downhole tool of claim 18, wherein the cyclonic separation assembly comprises:

a tubular housing having an inlet port extending radially therethrough;

an intake member disposed within the housing, wherein the intake member includes a feed tube, a guide member disposed about the feed tube, and a vortex tube coaxially disposed within the feed tube;

wherein the feed tube includes an inlet port in fluid communication with a first annulus positioned radially between the feed tube and the vortex tube and a flow passage positioned radially between the guide member and the feed tube;

wherein the vortex tube extends axially from a lower end of the feed tube;

a cyclone body disposed within the housing and extending axially from the feed tube, the cyclone body having an inner through passage in fluid communication with the feed tube and the vortex tube.

20. The downhole tool of claim 19, wherein the guide member has a first end radially spaced apart from the feed tube and a second end engaging the feed tube circumferentially adjacent the inlet port of the feed tube, the guide member being configured to direct fluid flow tangentially into the first annulus.

21. The downhole tool of claim 19, wherein the cyclone body has an upper end engaging the feed tube and a lower end distal the feed tube; and wherein the cyclone body includes an upper funnel extending from the upper end, a lower inverted funnel extending from the lower end, and a tubular member extending between the upper funnel and the lower funnel.

22. The separator of claim 21, wherein the upper funnel is radially spaced from the housing and the lower funnel engages the housing at the lower end of the cyclone body.

23. The downhole tool of claim 19, wherein each solids collection assembly comprises:

a tubular housing;

a funnel at least partially disposed within the housing; and a door assembly coupled to a lower end of the corresponding funnel;

wherein the housing of the first solids collection assembly is coupled to a lower end of the housing of the cyclonic separation assembly, and wherein the housing of the second solids collection assembly is coupled to a lower end of the housing of the first solids collection assembly.

* * * * *